US008106606B2

(12) United States Patent
Liu et al.

(10) Patent No.: US 8,106,606 B2
(45) Date of Patent: Jan. 31, 2012

(54) VOLTAGE MULTIPLE DIMMING CONTROL APPARATUS

(75) Inventors: Wen-Kuen Vincent Liu, Hsinchu (TW); Yi-Tai Chang, Hsinchu County (TW)

(73) Assignee: Holtek Semiconductor Inc., Hsinchu (TW)

( * ) Notice: Subject to any disclaimer, the term of this patent is extended or adjusted under 35 U.S.C. 154(b) by 427 days.

(21) Appl. No.: 12/540,733

(22) Filed: Aug. 13, 2009

(65) Prior Publication Data

US 2011/0006705 A1 Jan. 13, 2011

(30) Foreign Application Priority Data

Jul. 7, 2009 (TW) ..... 98122859 A

(51) Int. Cl.
*G05F 1/00* (2006.01)
*G09G 3/32* (2006.01)

(52) U.S. Cl. ..... 315/307; 315/291; 315/209 R; 315/223; 315/226; 315/276; 345/82; 345/102

(58) Field of Classification Search ..... 315/307, 315/224, 312, 291, 209 R, 223, 226, 276; 362/97.1, 97.2, 800; 345/82, 102, 204
See application file for complete search history.

(56) References Cited

U.S. PATENT DOCUMENTS

| | | | | |
|---|---|---|---|---|
| 7,928,956 | B2 * | 4/2011 | Chao et al. | 345/102 |
| 7,990,081 | B2 * | 8/2011 | Chandran et al. | 315/312 |
| 8,026,676 | B2 * | 9/2011 | Liu et al. | 315/291 |
| 8,063,583 | B2 * | 11/2011 | Liu | 315/291 |
| 2010/0315148 | A1 * | 12/2010 | Zhu et al. | 327/298 |

* cited by examiner

*Primary Examiner* — Vibol Tan
(74) *Attorney, Agent, or Firm* — Morris Manning & Martin LLP; Tim Tingkang Xia, Esq.

(57) ABSTRACT

The present invention discloses a control apparatus, which not only accepts multiple dimming control signals, but also combines the signals in analog manner. By means of this, an inevitable analog to digital converter in a conventional voltage multiple dimming control apparatus can be saved without hurting the performance of generation of pulse width modulation signals. Compared with the conventional arts, the present invention further exhibits reduction in view of chip size and power consumption.

5 Claims, 3 Drawing Sheets

VOLTAGE MULTIPLE DIMMING CONTROL APPARATUS

BACKGROUND OF THE INVENTION

1. Field of The Invention

The present invention relates to a voltage multiple dimming control apparatus, more particularly to, a voltage multiple dimming control apparatus for correctly generating pulse width modulation signals without using an analog to digital converter.

2. Description of The Prior Arts

Nowadays, LED plays a role of LCD backlight module, gradually, to replace the CCFL backlight module. And the dimming characteristics of the backlight module can provide a better viewing and power consumption saving. Compared with CCFL, LED can offer better dimming characteristics. Brightness for backlight, such as environmental light source sensing or color contents, for instance, can be manipulated in different approaches. Generally speaking, all of the various control approaches should be combined in order to reach an optimal value.

Refer to FIG. 1; a circuit diagram for conventional voltage multiple dimming control apparatus is illustrated, for which two dimming controls are included, and one of them is exhibited as pulse width modulation signal input terminal 1 whilst another is exhibited as a digital signal input 2. Furthermore, the conventional voltage multiple dimming control apparatus further comprises an additional input 3 so as to control the dimming frequency of a pulse width modulation generator.

The aforesaid pulse width modulation signal passes a low-pass filter thus its high-frequency ripples are filtered and its DC signal will be converted to a plurality of digital codes by an analog to digital converter 5.

The aforesaid digital codes should be digital in term of serial format or parallel format, which comprises a plurality of bits for signal dimming control. And the signal, overall speaking, will be used for further processing.

Also, two of the aforesaid dimming controls will be in process, and one of the processes is to multiplication of the two controls in order to obtain the desirable dimming rate. Unfortunately, a digital multiplier 6 will occupy a huge space and further consume a lot of power. Exemplarily, a multiplier characterized in 8 bits ×8 bits, requires at least 64 adders.

Accordingly, in view of the above drawbacks, it is an imperative that a voltage multiple dimming control apparatus is designed to generating a pulse width modulation signal without the cost of an analog to digital converter so as to solve the drawbacks as the foregoing and to further reduce the circuit die size and power consumption.

SUMMARY OF THE INVENTION

In view of the disadvantages of prior art, the primary object of the present invention relates to a voltage multiple dimming control apparatus, characterized in correct pulse width modulation without using an analog to digital converter.

According to one aspect of the present invention, one skilled in the art can come out a voltage multiple dimming control apparatus, comprising: a pulse width modulating signal input terminal, for inputting a pulse width modulating signal; a digital signal input terminal, for inputting a digital signal; a power signal to analog signal unit, for receiving the pulse width modulating signal and converting the same into a first analog signal and a second analog signal, where the second analog signal is smaller than the first analog signal in their references; a digital to analog unit, for receiving the digital signal and converting the same into a third analog signal and a fourth analog signal, where the fourth analog signal is smaller than the third analog signal in their references; a first multiplying unit, for multiplying the first analog signal with the third analog signal so as to generate a first product; a second multiplying unit, for multiplying the second analog signal with the fourth analog signal so as to generate a second product; a voltage slope generating unit, for receiving a frequency setup signal to generate a sloped voltage; and a judging unit, for generating an on-or-off signal or a reset signal based upon said sloped voltage, said first product, and said second product, where the on-or-off signal On/Off is used for turning on or turning off a dimming output, and said reset signal is for resetting the voltage slope generating unit.

Hence, the present invention discloses an approach devoid of the conventional analog to digital converter, which an correctly generate pulse width modulating signal so that the whole circuit utilization die size and the operating power can be further reduced.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become readily understood from the detailed description given herein below and the accompanying drawings which are given by way of illustration only, and thus are not limitative of the present invention and wherein.

DESCRIPTION OF THE EXEMPLARY EMBODIMENTS

The following descriptions are of exemplary embodiments only, and are not intended to limit the scope, applicability, or configuration of the invention in any way. Rather, the following description provides a convenient illustration for implementing exemplary embodiments of the invention. Various changes to the described embodiments may be made in the function and arrangement of the elements described. For your esteemed members of reviewing committee to further understand and recognize the fulfilled functions and structural characteristics of the invention, several exemplary embodiments cooperating with detailed description are presented as the follows.

Figure 1:
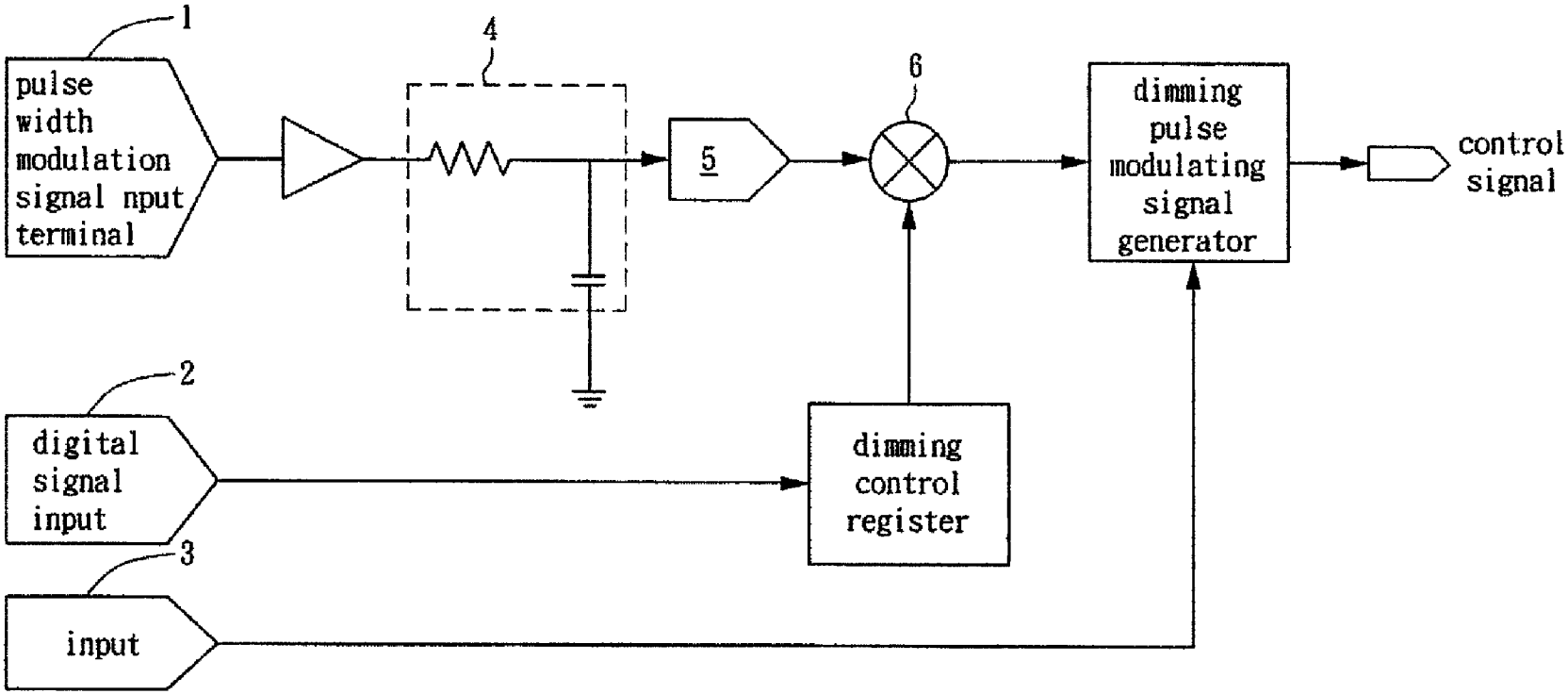
FIG. 1 (Prior Art)
FIG. 1 relates to a circuit diagram of the conventional voltage multiple dimming control apparatus.
Figure 2:
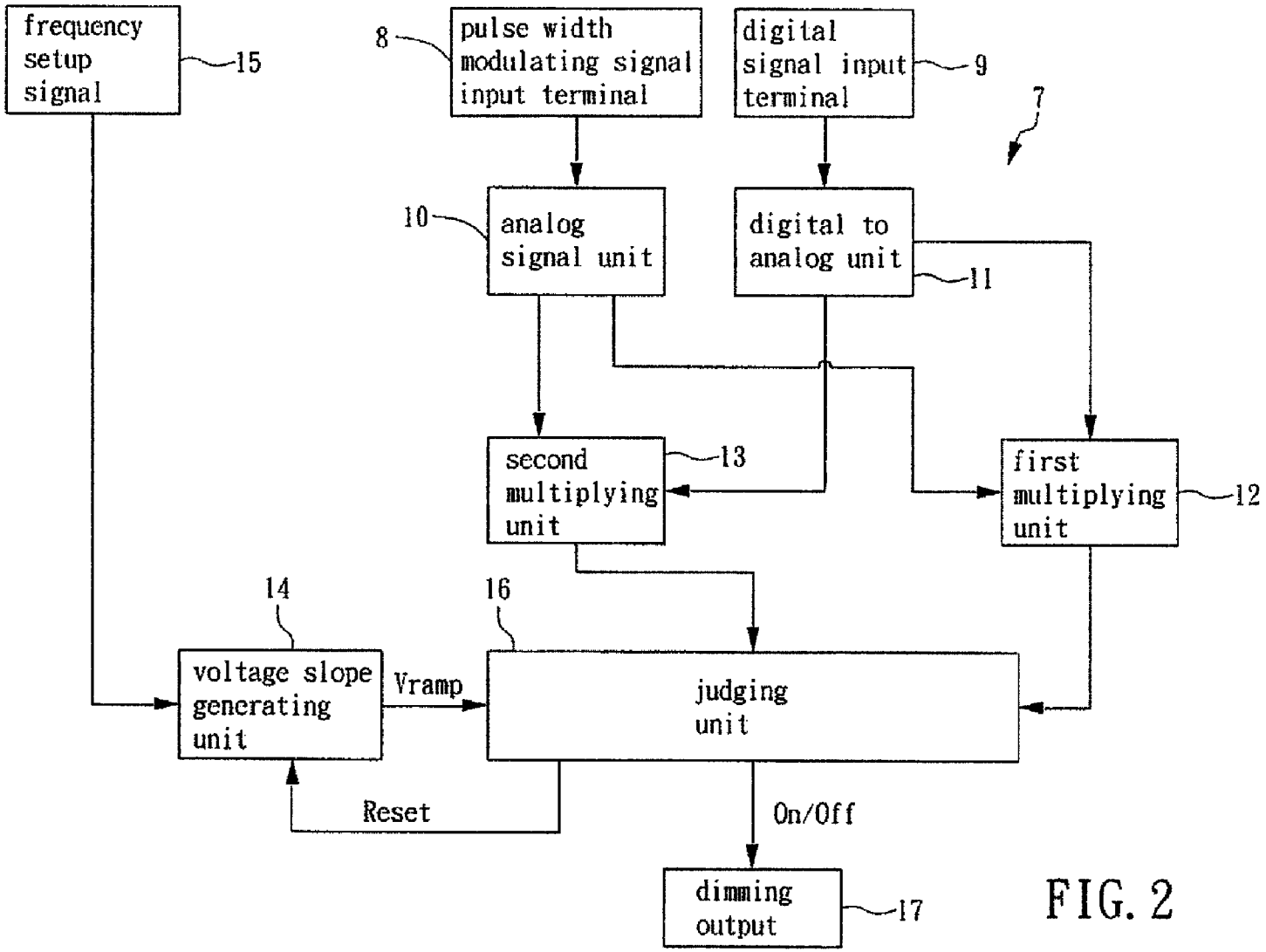
FIG. 2 relates to a functional block diagram of a preferred embodiment according to the present invention.
Figure 3:
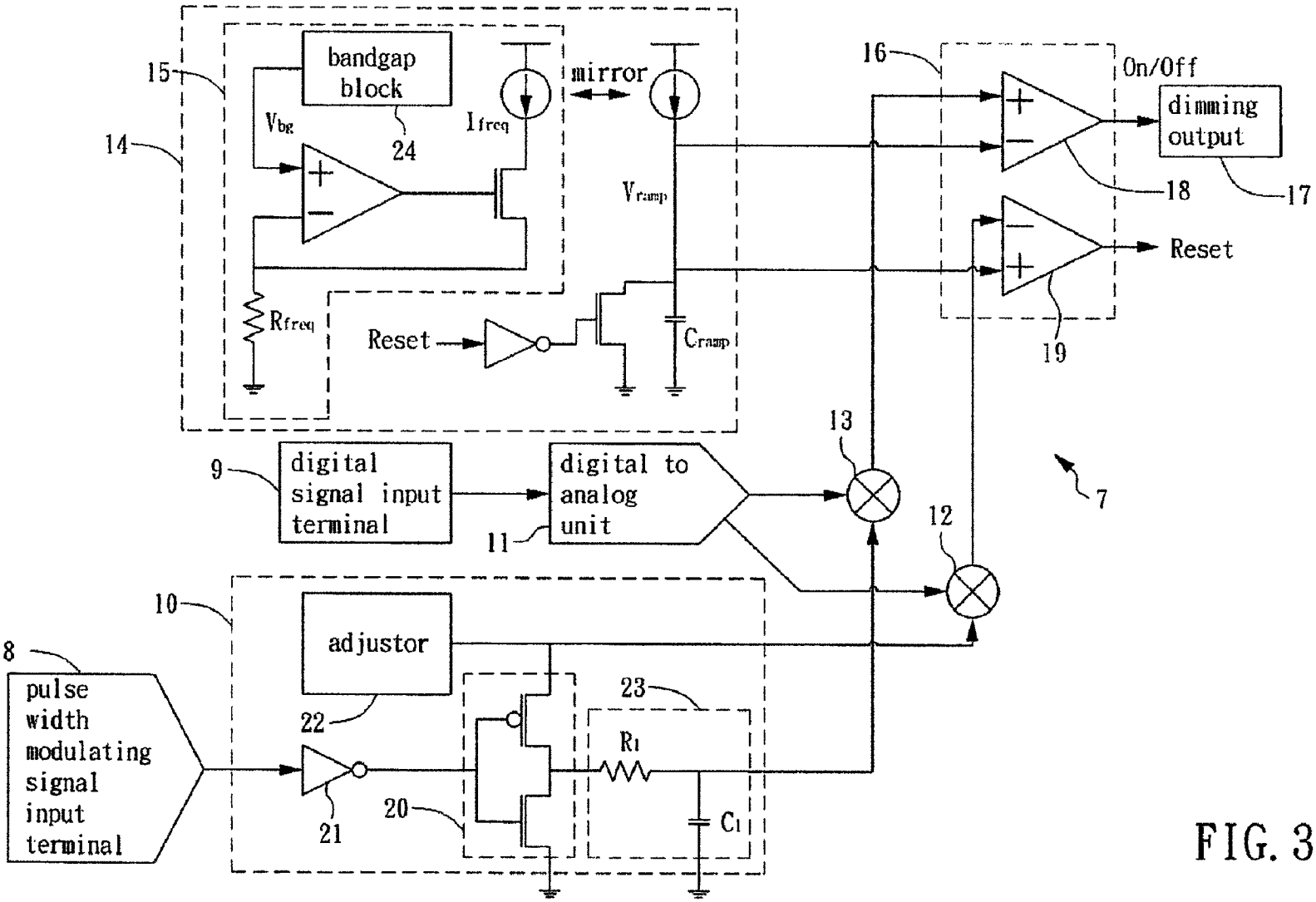
FIG. 3 relates to a circuit diagram of a preferred embodiment according to the present invention.

Turning up to FIG. 2 and FIG. 3, which illustrate a functional block diagram and a circuit diagram respectively as one of the preferred embodiments of the present invention. The present invention relates to a voltage multiple dimming control apparatus 7, comprises: a pulse width modulating signal input terminal 8, for inputting a pulse width modulating signal; a digital signal input terminal 9, for inputting a digital signal; a power signal to analog signal unit 10, for receiving the pulse width modulating signal and converting the same into a first analog signal and a second analog signal, where the second analog signal is smaller than the first analog signal in their references; a digital to analog unit 11, for receiving the digital signal and converting the same into a third analog signal and a fourth analog signal, where the fourth analog signal is smaller than the third analog signal in their references; a first multiplying unit 12, (such as an analog multiplier), for multiplying the first analog signal with the third analog signal so as to generate a first product; a second multiplying unit 13 (such as an analog multiplier), for multiplying the second analog signal with the fourth analog signal so as to generate a second product; a voltage slope generating unit 14, for receiving a frequency setup signal 15 to generate a sloped voltage Vramp; and a judging unit 16, for generating an on-or-off signal On/Off or a reset signal based upon said sloped voltage Vramp, said first product, and said second product, where the on-or-off signal On/Off is for turning on or turning off a dimming output 17, said reset signal Reset is for resetting the voltage slope generating unit 14. Generally speaking, the judging unit 16 can be composed of a first comparator 18 and a second comparator 19, wherein the first comparator 18 is for comparing the second product and the sloped voltage Vramp to generate the on-or-off signal, and the second comparator 19 is for comparing the first product and the sloped voltage Vramp to generate the Reset. The power signal to analog signal unit 10 comprises: a CMOS 20, which includes a first terminal, a second terminal, a third terminal, and a fourth terminal, wherein the third terminal is connected to ground; an inverter 21, having an input terminal coupled to the pulse width modulating signal input terminal 8 and having an output terminal coupled to the first terminal; an adjustor 22, coupled to the second terminal, for adjusting the first analog signal; and a low-pass filter 23, coupled to the fourth terminal, for outputting the second analog signal.

As the follows, the first product and the second product are further illustrated in the preferred embodiment in the present invention, together with how to judge the time frame for generating the on-or-off signal or the aforesaid Reset. Please refer to FIG. 2 and FIG. 3 again, the pulse width modulating signal will convert its duty cycle to be the second analog signal, whose maximum analog reference value is determined by the first analog signal. Meanwhile, the digital signal is as well converted to be the fourth analog signal and the third analog signal, and the maximum analog reference value of the fourth analog signal is determined by the third analog signal. Afterwards, the second analog signal is multiplied by the fourth analog signal so as to obtain the second product, and the first analog signal is multiplied by the third analog signal so as to obtain the first product. After the aforesaid second product and first product are obtained, there will be a comparison between the sloped voltage Vramp and the first product/second product. While the sloped voltage Vramp is smaller than the second product, then the backlight will be turn on by said on-or-off signal (On). While the sloped voltage Vramp is larger than the second product but smaller than the first product, then the backlight will be turn off by said on-or-off signal (Off). While the sloped voltage Vramp is larger than the first product, then the Reset will be generated so as to enact the whole judge flow to be re-circling. As illustrated by FIG. 3, the low-pass filter 23 is composed of a resistor R1 and a capacitor C1 for facilitate the conversion from the pulse width modulating signal to the second analog signal. The dimming frequency for the backlight can be controlled by a variable resistor Rfreq that is used for generate an accurate current Ifreq. Correspondingly, an accurate voltage is generated by a bandgap block 24, and their mutual relationship refers as: Ifreq=Vbg/Rfreq . . . (1)

The accurate current Ifreq will be mirrored and to charge a capacitor Cramp so as to generate the sloped voltage Vramp. While the sloped voltage Vramp is greater than the first product, the Vramp will be repeatedly and periodically reset so as to generate a periodic saw-tooth waveform, and its frequency can be expressed as Ifreq/(Cramp*the first analog signal*the third analog signal) . . . (2)

From the substitution between the equation (1) and the equation (2), the skilled artisan can have: its frequency can be also express as: Vbg/Rfreq*(Cramp*the first analog signal*the third analog signal).

Further in view of the dimming loading efficiency, that is, the second product/the first product . . . (4) the skilled artisan can control the desirable brightness.

From the aforesaid statement, the present invention can be clearly understood as providing a voltage multiple dimming control apparatus, without using any analog to digital converter, which is still able capable of generating a pulse width modulating signal whilst the circuit die size of the whole apparatus and power consumption can be reduced.

The invention being thus aforesaid, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A voltage multiple dimming control apparatus, comprising:

a pulse width modulating signal input terminal, for inputting a pulse width modulating signal;

a digital signal input terminal, for inputting a digital signal;

a power signal to analog signal unit, for receiving the pulse width modulating signal and converting the same into a first analog signal and a second analog signal, where the second analog signal is smaller than the first analog signal in their references;

a digital to analog unit, for receiving the digital signal and converting the same into a third analog signal and a fourth analog signal, where the fourth analog signal is smaller than the third analog signal in their references;

a first multiplying unit, for multiplying the first analog signal with the third analog signal so as to generate a first product;

a second multiplying unit, for multiplying the second analog signal with the fourth analog signal so as to generate a second product;

a voltage slope generating unit, for receiving a frequency setup signal to generate a sloped voltage; and a judging unit, for generating an on-or-off signal or a reset signal based upon said sloped voltage, said first product, and said second product, where the on-or-off signal On/Off is used for turning on or turning off a dimming output, and said reset signal is for resetting the voltage slope generating unit.

2. The voltage multiple dimming control apparatus as recited in claim 1, wherein said first multiplying unit is an analog multiplier.

3. The voltage multiple dimming control apparatus as recited in claim 1, wherein said second multiplying unit is an analog multiplier.

4. The voltage multiple dimming control apparatus as recited in claim 1, wherein said judging unit further comprises a first comparator for comparing the second product and the sloped voltage to generate the on-or-off signal, and a second comparator for comparing the first product and the sloped voltage to generate the reset signal.

5. The voltage multiple dimming control apparatus as recited in claim 1, wherein said power signal to analog signal unit further comprises:

a CMOS, including a first terminal, a second terminal, a third terminal, and a fourth terminal, wherein the third terminal is connected to ground;

an inverter, having an input terminal coupled to the pulse width modulating signal input terminal and having an output terminal coupled to the first terminal;

an adjustor, coupled to the second terminal, for adjusting the first analog signal; and a low-pass filter, coupled to the fourth terminal, for outputting the second analog signal.

* * * * *